US007101062B2

(12) United States Patent
Albou et al.

(10) Patent No.: US 7,101,062 B2
(45) **Date of Patent: *Sep. 5, 2006**

(54) HEADLIGHT EMPLOYING A COMBINED MIRROR AND DEFLECTION ELEMENT WITH A NON-FLAT LIGHT BEAM CUT-OFF LINE

(75) Inventors: Pierre Albou, Bobigny Cedex (FR); Stephanie Figuiere, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 180 days.

This patent is subject to a terminal disclaimer.

(21) Appl. No.: 10/665,316

(22) Filed: Sep. 18, 2003

(65) Prior Publication Data

US 2004/0057245 A1 Mar. 25, 2004

(30) Foreign Application Priority Data

Sep. 20, 2002 (FR) ..... 02 11704

(51) Int. Cl.
*F21V 7/00* (2006.01)

(52) U.S. Cl. ..... 362/299; 362/309; 362/337; 362/340; 362/346; 362/518; 362/522

(58) Field of Classification Search ..... 362/507, 362/516–518, 520–522, 296–297, 299–300, 362/302, 307–309, 311, 326–328, 335–338, 362/339–341, 346

See application file for complete search history.

(56) References Cited

U.S. PATENT DOCUMENTS

| | | | | | |
|---|---|---|---|---|---|
| 3,497,687 | A * | 2/1970 | Hermann | 362/244 |
| 4,351,018 | A * | 9/1982 | Fratty | 362/215 |
| 4,796,171 | A * | 1/1989 | Lindae et al. | 362/308 |
| 4,885,669 | A * | 12/1989 | Nino | 362/517 |
| 4,916,585 | A * | 4/1990 | Nino | 362/518 |
| 4,945,454 | A * | 7/1990 | Bunse et al. | 362/518 |
| 5,008,781 | A * | 4/1991 | Nino | 362/518 |
| 5,406,464 | A * | 4/1995 | Saito | 362/518 |
| 6,004,014 | A * | 12/1999 | Yamamura et al. | 362/518 |
| 6,637,914 | B1 * | 10/2003 | Naganawa | 362/465 |

* cited by examiner

*Primary Examiner*—Sandra O'Shea
*Assistant Examiner*—Jason Han
(74) *Attorney, Agent, or Firm*—Morgan & Finnegan, LLP

(57) ABSTRACT

The present invention relates to a headlight device comprising in particular a light source, a mirror exhibiting a reflecting surface and a transparent optical deflection element positioned in front of the mirror, the mirror being capable of interacting with the light source in order to generate a beam bounded by a line of interruption, and the deflection element being capable of providing a horizontal displacement of the light without modifying the vertical distribution of the latter, and at least one detachment element arranged on at least one of the surfaces of the mirror or of the optical deflection element reached by the light to obtain a line of interruption of the light beam that is not flat.

19 Claims, 5 Drawing Sheets

HEADLIGHT EMPLOYING A COMBINED MIRROR AND DEFLECTION ELEMENT WITH A NON-FLAT LIGHT BEAM CUT-OFF LINE

FIELD OF INVENTION

Motor vehicle headlight device with combined mirror and deflection element with an interruption of the light beam that is not flat.

BACKGROUND OF INVENTION

The object of this invention is a motor vehicle headlight device comprising essentially a combined mirror and deflection element designed to produce a light beam whose interruption is not flat. The essential object of the invention is to provide an improvement in the headlight device of prior art, this improvement consisting in the introduction of modifications to the surfaces of the mirror and/or deflection element in order to obtain an interruption of the light beam produced that is not flat. The headlight device, initially designed as a fog light, may therefore be used as a headlight device of the dipped headlight type in particular.

SUMMARY OF THE INVENTION

The scope of the invention is generally that of motor vehicle headlights, where various types of headlights are known, including essentially:

sidelights of low intensity and range;

dipped headlights, or low beams, with a higher intensity and range on the road close to 70 meters, which are used essentially at night and whose light beam distribution is such that it prevents the driver of an oncoming vehicle from being dazzled;

long-range headlights on full beam, and additional long-range lights, with an area of vision on the road approaching 200 meters, and which must be switched off when passing another vehicle in order not to dazzle its driver;

improved headlights, so-called bi-mode headlights, which combine the functions of dipped and main beam headlights by incorporating a detachable mask;

fog lights.

The application of the headlight device according to the invention lies essentially in its use as full beam headlights because it conforms perfectly to the standards for this type of light. Nevertheless, it may also be used in any other of the above-mentioned headlight devices mentioned that undergo prescriptive development. The fact that the invention is described in the context of dipped beam headlights therefore by no means restricts it to this single application.

In the field of headlight devices there are two main families corresponding to two distinct arrangements of headlight elements.

The first family is that of the so-called parabolic headlights. In this type of headlight a beam of light is generated by a light source of small dimension arranged in a reflector, or mirror. The projection onto the road of the light rays reflected by a suitable reflector directly produces a light beam that meets the various constraints imposed by the standards. Such a headlight device may possibly be supplemented by an exit surface of the mirror type which can be provided with ridges, for example, for modifying the light beam, for example by increasing its width. This family of headlights includes so-called clear or complex surface headlights, which enable a light beam with a desired interruption, or line of interruption, to be obtained directly. Line of interruption refers to the boundary between a low area illuminated by the headlight device and a high area which is not illuminated by the headlight device. The precise realisation of the complex surfaces, which were previously the subject of extensive calculations, enables such an interruption to be obtained at the outlet of the parabolic headlight device.

This type of headlight is particularly efficient in terms of reduced depth and light distribution. One of the difficulties encountered in the development of these headlights is that it is necessary for their mirror to recover a high proportion of the light signals produced by the light source, with the disadvantage that it produces a light beam of insufficient intensity. A compromise must then be found between two solutions. The first solution consists in using a very small basic focal length to obtain a mirror that is enclosed tightly around the light source and is not very wide. However, because of the size of the images of the light source generated by the mirror, large in this case, the light beam is then too thick, and hence difficult to control. The second solution consists in increasing the basic focal length, but the mirror then exhibits large dimensions transversally to the optical axis, the headlight device no longer being compact.

The second family is that of the so-called elliptical headlights. In this type of headlight a spot of luminous concentration is generated by a light source arranged in a mirror. The light source is typically arranged at the first focus of an ellipsoid revolving mirror, the said spot being formed at the second focus of the mirror. The spot of luminous concentration is then projected onto the road by a converging lens, for example a lens of the plano-convex type. In order to obtain an interruption in the light beam produced by the device, the spot of luminous concentration is partially covered, for example by means of a metal mask arranged inside the headlight device.

This type of headlight is particularly efficient in terms of recovering the light signals transmitted by the light source; its dimensions transversal to the optical axis are, moreover, relatively small, which is a further advantage. On the other hand, this type of headlight occupies considerable space in terms of depth, and the photometry is difficult to control because no ridged corrective element is able to correct the light beam deriving from the lens.

Within these two headlight families strong demands have recently been made for headlight devices that meet the following criteria:

firstly it is sometimes necessary to provide headlight devices that are moderate in size, not only transversally to the optical axis, as is the case with elliptical headlights, but also in terms of depth, i.e. along the optical axis, as is the case with parabolic headlights. None of the headlights belonging to these two families just described are able to meet this first criteria, to the detriment of the quality of lighting they provide;

secondly there is a requirement on the part of stylists concerning the external appearance of the different types of headlights. The two families of headlights described have very different external appearances: the parabolic headlights exhibit a mirror with a relatively large width, in most cases ridged, and when they are switched on the mirror and various embellishments can be clearly seen inside them. In the elliptical headlights a smooth mirror is seen, through which only an external convex lens face is distinguished, possibly surrounded by a suitable embellishment. The juxtaposition of an elliptical and a parabolic headlight may annoy some stylists because of the glaring differences in appearance between these types of headlights.

In order to meet these demands a special headlight device has recently been proposed which will be designed as a basic hybrid headlight. The basic hybrid headlight, whilst technically belonging to the family of parabolic headlights—it has no mask to create an interruption in the light beam—presents, when switched on, an external appearance that is closer to that of the elliptical headlights than to the classic parabolic headlights. Moreover, the basic hybrid headlight device proposed produces a light beam of good quality.

The design principle of the basic hybrid headlight device is represented diagrammatically, in an axial horizontal section, in FIG. 1. Only the construction of a lateral half of the basic hybrid headlight is illustrated, the other half being capable of being constructed on the basis of the same instructions, whether symmetrically or not. Mention is made in the following to an orthonormal system of reference where O is at the geometric centre of a light source 10, Y—Y is the optical axis, X—X is the horizontal axis transversal to the optical axis of the headlight, and Z—Z is the vertical axis.

The headlight device is composed essentially of a lamp accommodating light source 10, a mirror 20 and a transparent optical deflection element 30, called here a lens, located in front of mirror 20. Mirror 20 is capable of interacting with light source 10 in order to generate a beam bounded by a line of interruption, and deflection element 30 is capable of providing a horizontal dispersal of the light without appreciably altering the vertical distribution of the light. Generally speaking, the light beam produced by a headlight device consists of a superposition of all the images of the light source after reflecting the light signals it transmits onto the reflecting surface of mirror 10, and after passing through lens 30.

Light source 10 is arranged axially along optical axis Y—Y of mirror 20, whose generating line 21 describes a curve $y=f_{20}(x)$, which will be explained below. Within the present state of the art there are numerous publications describing such mirrors. For example, we may quote document DE-A-42 00 989, which describes in detail a generic method for mathematically producing such surfaces from any horizontal generating line. Lens 30 is arranged transversally to axis OY and has an inner face 31, or admission face, that receives the light reflected by the mirror, and an outer face 32, or exit face that is smooth, flat and perpendicular to axis OY. Inner face 31 of lens 30 has a horizontal section describing a continuous, and preferably derivable curve $y=f_{30}(x)$, which will be explained below. Lens 30 is obtained by displacing a vertical directrix along this curve to form its inner face, the lens thus being cylindrical. Mirror 20 and inner face 31 of lens 30 are produced on the basis of a desired behaviour in terms of propagation of the rays that are reflected and refracted, respectively.

A method for manufacturing a basic hybrid headlight device of this kind may be designed according to a method illustrated in particular in FIGS. 1, 2*a* and 2*b*, comprising the following different stages consisting in:

establishing a first law expressing a second lateral distance $\chi$, in relation to optical axis Y—Y of the headlight, from a point of impact of a ray reflected onto a reference straight light of equation y=y1, located in the vicinity of deflection element 30, as a function of a first lateral distance x, in relation to this same optical axis Y—Y, from the point of reflection of the said ray reflected onto a horizontal generating line of the mirror; an example of this first law is given in FIG. 2*a;* on the basis of this first law, determining horizontal generating line 21 of the mirror;

on the basis of the said horizontal generating line, and as a function of a vertical interruption sought for the beam, mathematically constructing a reflecting surface of the mirror;

on the basis of the mathematical construction of the reflecting surface, machining an impression for the manufacture of the mirror with the said reflecting surface;

manufacturing mirror 20 using the said impression;

establishing a second law expressing a horizontal angular deflection θ, in relation to the optical axis of the headlight, of the ray reflected by the mirror, as a function of the said first lateral distance x; an example of this second law is given in FIG. 2*b;* on the basis of this second law, determining a horizontal section of deflection element 30;

on the basis of this horizontal section, mathematically constructing admission surface 31 and exit surface 32 of light of the deflection element;

on the basis of the mathematical construction of the admission and exit surfaces, machining a mould for manufacturing the deflection element with the said admission and exit faces, and manufacturing deflection element 30 using the said mould.

In the description, and particularly with reference to FIGS. 2*a* and 2*b*, the half-width of mirror 20 and lens 30 is denoted by D/2.

The horizontal generating line of mirror 20 is constructed in order to conform to a given law, an example of which is shown in FIG. 2*a*, giving a dimension $\chi(x)$, which is therefore a function of abscissa x. Dimension $\chi(x)$ corresponds to a point of impact, on a theoretical straight line of equation y=y1, in the plane shown in FIG. 1, of a ray of light reflected at the point of dimension x of the horizontal generating line of mirror 20.

Such a law enables different forms of horizontal generating lines to be modelled. The law that has been selected enables the quantity of luminous flux recovered by the mirror to be controlled by determining the manner in which the mirror surrounds the light source. In FIG. 2*a* the horizontal generating line exhibits an elliptical shape ($\chi(x)=0$) from dimension 0 to dimension x=x1. Between this dimension x1 and maximum dimension x=D/2, the point of impact of the reflected ray then develops progressively between $\chi(x)=0$ and $\chi(x)=D/2$, the latter dimension corresponding to the extreme lateral dimension of lens 30. Preventing $\chi(x)$ from exceeding D/2 ensures that most, indeed all of the radiation reflected by mirror 20 safely reaches the admission face of lens 30. Horizontal generating line 21 of mirror 20 therefore develops progressively, from dimension x1, from an elliptical to a parabolic appearance.

FIG. 2*b* shows an example of a law defining the shape of the inner horizontal section of the lens, defined by the curve $y=f_{30}(x)$. This law enables a final horizontal deflection θ(x) to be established, which therefore depends on dimension x imparted to a ray reflected by generating line 21 of the mirror. In the example given, where by convention the deflections to the left are assigned a negative sign, the following different behaviours are observed:

between dimensions 0 and x2 the deflection passes progressively from 0 to a limit angle $-\theta_L$;

between dimensions x2 and x3 the deflection passes progressively from the maximum value $-\theta_L$ to 0;

between dimensions x3 and D/2 the deflection is zero.

Curves $y=f_{20}(x)$ and $y=f_{30}(x)$, which define the horizontal generating line of the mirror and the admission face of the lens respectively, and hence their entire three-dimensional shape, according to the data in the documents previously quoted, may easily be defined as a function of the laws described by a system of differential equations available to the person skilled in the art. The combination of the laws illustrated in FIGS. 2*a* and 2*b* therefore enables a mirror and a lens to be designed by adjusting firstly the horizontal deflection of the radiation imparted by the mirror, and hence the recovery by this same mirror of the luminous flux transmitted by light source 10, and secondly the horizontal deflection of the radiation imparted by lens 30.

By taking the following values, expressed in millimeters: D=90, y1=130, x1=x3=30, x2=10, and $\theta_L=35°$, a mirror and lens are obtained whose appearance is shown in FIGS. 3 to 6.

In these figures the lens, which is represented by solid lines in its theoretical shape, with a square contour, is provided with a circular contour 33 represented by dashes in FIG. 6. The hybrid headlight device, when switched off, therefore displays an appearance and a shape similar to a lens normally used in headlight devices of the elliptical type due to its smooth faces and circular contour. It is also observed that contour 23 of mirror 20 is provided to eliminate from it any area that is likely to reflect the light to the outside of circular contour 33 of the lens.

The hybrid headlight device just described therefore constitutes a headlight that is compact in width and depth, capable of generating a satisfactory beam in terms of intensity due to the small loss of light signals inside the hybrid headlight device, and exhibiting an appearance close to that of an elliptical headlight.

Several variants approaching the structure described are also considered to be basic hybrid headlights:

mirror 20 and lens 30 may have different widths, the width of the mirror being equal to or less than that of the lens;

the lens may be designed not with a smooth, flat outer face and an inner face designed as described above, but with a smooth, flat inner face and an outer face designed as described above, or even with an inner and outer face that are both finely worked.

One of the characteristics of the basic hybrid headlights that have just been described is that they generate a flat line of interruption, in most cases horizontal. Whilst such a line of interruption is satisfactory for producing certain types of headlight devices, such as fog lights, it does not meet certain standards which prescribe a line of interruption that is not flat for certain other devices. This is particularly the case with headlight devices of the dipped beam type, for which either a break 70 must be found on a line of interruption 71 represented diagrammatically in FIG. 7*a*, level with the optical axis, so that the beam illuminates at a higher level on one side of the road than the other, as is the case with the American dipped headlights, or an inclined line of interruption 72 must be observed, as represented diagrammatically in FIG. 7*b*, which exhibits at the level of the optical axis an angle 73 of the order of 15 degrees to the horizontal, but only on one side of the road, as is typically the case for European dipped headlights.

Traditionally, when an attempt is made to create a line of interruption that is not flat in a light beam reflected by a mirror, certain parts of the mirror surface are rotated. In fact, when a mirror is developed displaying a complex surface, designed to reflect light signals produced by a light source, in order to create a light beam whose homogeneity meets the requirements laid down in the different standards whilst showing a line of interruption of the light beam, the shape and position of ridges to be arranged on the mirror are calculated to achieve the desired homogeneity. However, because these calculations always result in the creation of flat interruptions, it is then necessary to rotate certain parts of the reflecting surface of the mirror, particularly certain ridges, the images of the light source created by these rotated sections thus producing a group of light rays within the light beam produced by the headlight device. These give rise to an interruption which is not flat and which is able to meet the standards governing European and/or American dipped headlights.

It is not possible to proceed thus with the basic hybrid headlights that have been described due to the presence of lens 30. In fact, as has previously been seen, the role of lens 30 is to distribute horizontally the light rays that reach the inner face after reflection on mirror 20. Rotating part of mirror 20 would therefore give rise not to a shift in the line of interruption, but a diffuse spot covering a large part of the width of the beam due to the horizontal distribution caused by the lens.

The problem of creating an interruption that is not flat at the outlet of a headlight device of the hybrid type cannot therefore be resolved by the techniques used for the parabolic headlight devices.

One of the objects of the invention is to counteract this problem. Generally speaking, an improved hybrid headlight device is proposed in the invention, as opposed to the basic hybrid headlights that have just been described, i.e. compact in width and depth capable of generating a satisfactory light beam and exhibiting an appearance similar to that of an elliptic headlight, this improved hybrid type headlight having undergone several modifications to obtain a line of interruption of the light beam that is not flat.

For this purpose vertical rotation of certain surface areas of the mirror and/or lens is proposed in the invention, so that the inclination of these areas is modified, thus giving rise to a shift towards the top of some of the images, constituting the light beam, from the light source.

The invention therefore relates essentially to a headlight device comprising in particular a light source, a mirror exhibiting a reflecting surface for reflecting light signals produced by the light source and a transparent optical deflection element exhibiting an admission face for the reflected light signals and an exit face for the reflected light signals, the transparent deflection element being located in front of the mirror, the mirror being capable of interacting with the light source to generate a beam bounded by a line of interruption, and the deflection element being capable of providing horizontal distribution of the light signals produced by the light source and reflected by the mirror, without modifying the vertical distribution of the light signals, the said headlight device being characterised in that it comprises at least one detaching device arranged on at least one of the surfaces reached by the light signals to obtain a line of interruption of the light beam that is not flat.

The method according to the invention may also exhibit one or more of the following characteristics:

at least one detaching device consists of at least one prism arranged on the transparent optical deflection element;

among the prisms arranged on the optical deflection element at least one lateral prism is arranged on a lateral vertical strip of the optical deflection element;

among the prisms arranged on the optical deflection element a central prism is arranged on a central vertical strip, one of the edges of that central vertical strip being combined with a vertical central axis of the optical deflection element;

one base of each prism is arranged toward the top of each vertical strip on which it is arranged, one apex of each prism being arranged toward the bottom of each vertical strip on which it is arranged;

each prism is arranged on the admission face of the reflected light signals from the optical deflection element;

at least one detachment consists in rotating a vertical strip constituting the reflecting surface of the mirror relative to an adjacent vertical strip of the mirror;

among the rotation operations carried out on the surface of the mirror is at least one lateral rotation of a lateral vertical strip of the mirror;

among the rotation operations carried out on the surface of the mirror, a central rotation device is arranged on a central vertical strip of the mirror, one of the edges of this central vertical strip being combined with a vertical central axis of the mirror;

each rotation of a vertical strip of the mirror is carried out so that connection surfaces appearing between the rotated vertical strips and the adjacent vertical strips are exposed at least to the light signals produced by the light source;

at least one detachment consists in replacing a particular section of the reflecting surface of the mirror, the said particular section corresponding to the lateral ends of a piece of surface of the mirror resulting from the intersection of the reflecting surface of the mirror and the space defined between a first central horizontal plane of the mirror and a second plane, inclined in relation to the first plane, by a surface of the paraboloid type;

at least one detachment consists in the replacement of a particular section of the admission face of the reflected light signals from the transparent optical deflection element, the said particular section corresponding to the lateral ends of a piece of surface of the said admission face resulting from the intersection of the said admission face and the space defined between a first central horizontal plane of the mirror and a second plane, inclined in relation to the first plane, by a flat surface;

the inclination between the first plane and the second plane is of the order of 15 degrees.

A further object of the invention is a motor vehicle equipped with at least one headlight device exhibiting at least one of the features that have just been described.

BRIEF DESCRIPTION OF THE DRAWINGS

The invention and its various applications will be more clearly understood on reading the following description and on examining the figures accompanying it. They are presented for information only and they by no means restrict the scope of the invention.

DESCRIPTION OF THE PREFERRED EMBODIMENTS

In the various figures the elements that are common to several figures will have retained the same references.

Figure 7A:
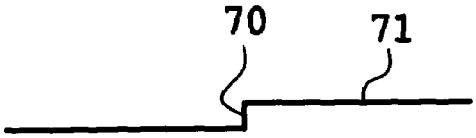
FIGS. 7*a* and 7*b* show examples of a diagrammatic representation of lines of interruption required to be obtained with the headlight device according to the invention.

According to the invention, in order to obtain an interruption that is not flat, of the type shown in FIG. 7*a*, several embodiments are proposed: in all these examples the reflecting surface of mirror 20 of the basic hybrid headlights and/or admission face 31 of lens 30 of these same headlights has/have been slightly modified.

Figure 8A:
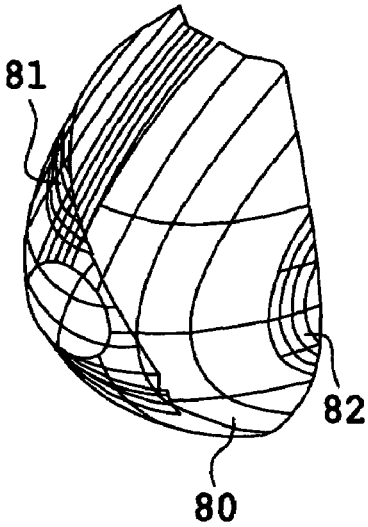
FIGS. 8*a* to 8*c* show different views of an embodiment of the surface of the mirror installed in the headlight device according to the invention.
Figure 8B:
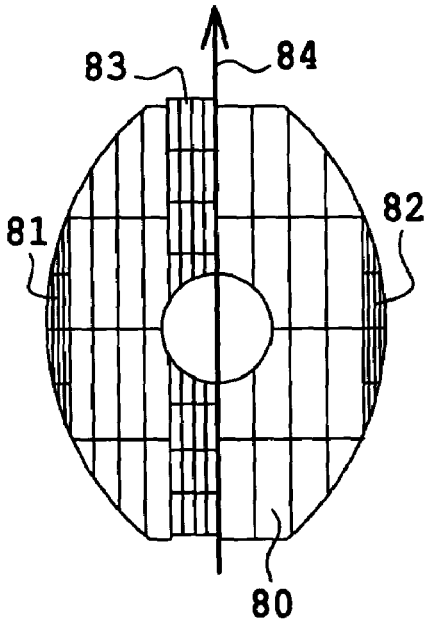
Figure 8C:
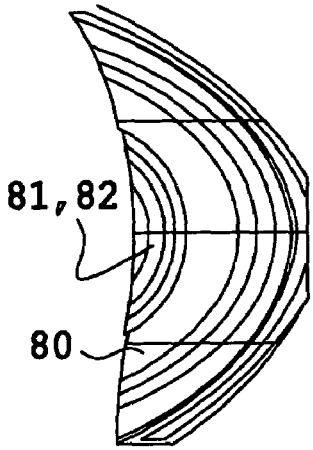

This provides, for example, a new mirror 80, a possible embodiment of which is shown in FIGS. 8*a* (front elevation of the mirror) to 8*c*, in different views. As part of these modifications to the reflecting surface of the mirror, detaching devices have been introduced on this surface. Considering that the reflecting surface of mirror 80 is a juxtaposition of an assembly of adjacent vertical strips, a detaching device is intended here to rotate one of these vertical strips. Within the framework of the invention it is possible to rotate a left-hand lateral vertical strip 81, which corresponds to the left end of the reflecting surface of the mirror, and/or rotate a right-hand lateral vertical strip 82, which corresponds to the right-hand end of the reflecting surface of the mirror, and/or to rotate a central vertical strip 83, corresponding to a strip adjacent to vertical central axis 84 of the mirror.

Figure 1:
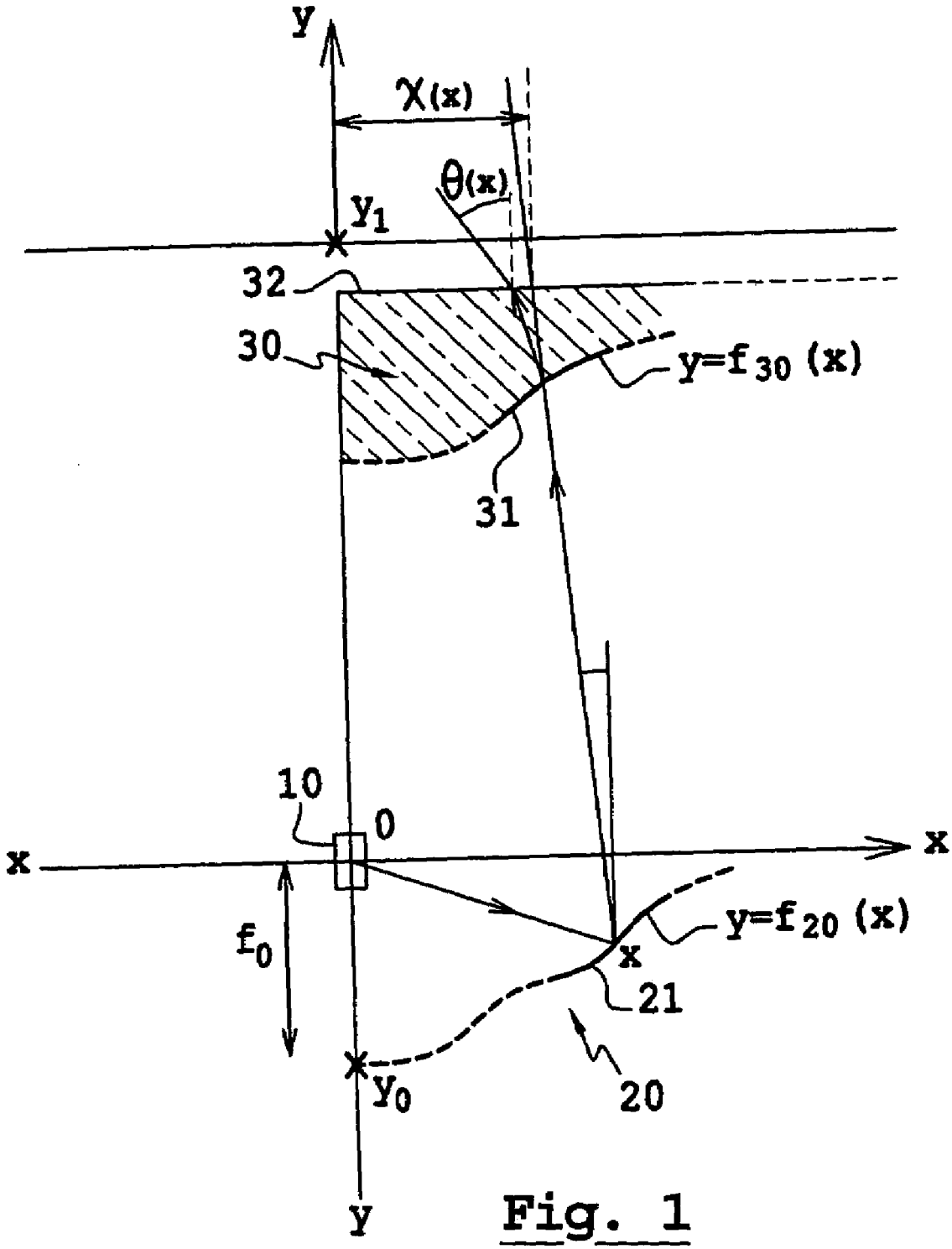
Fig. 1 (Prior Art)
FIG. 1, already described, illustrates diagrammatically, in an axial horizontal section, the design principle of a basic hybrid headlight.
Figure 2A:
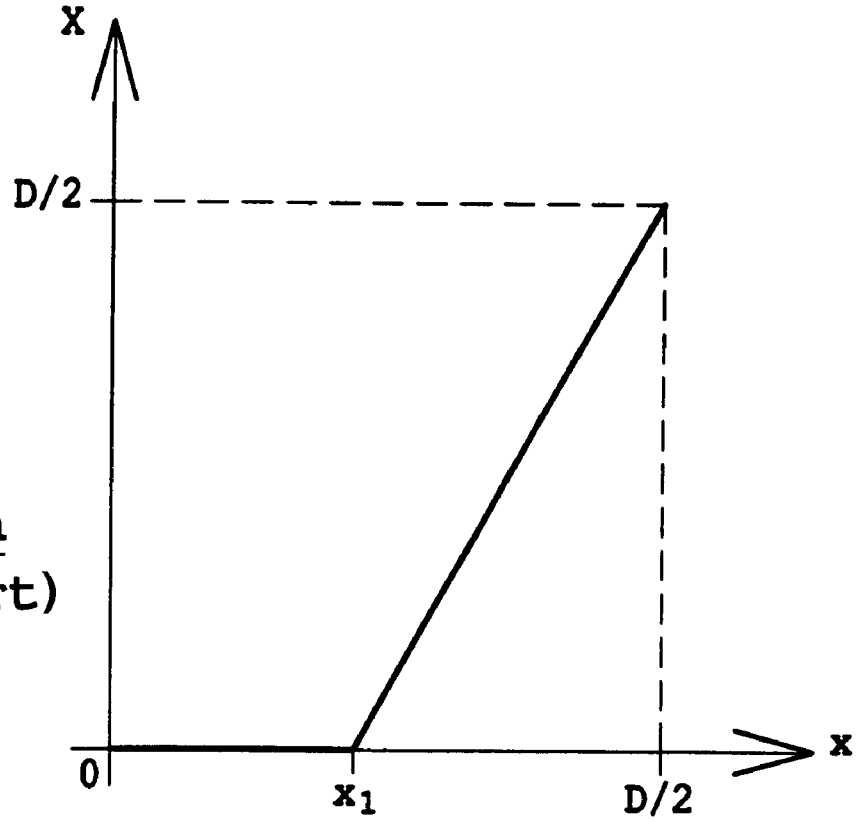
Fig. 2a (Prior Art)
FIGS. 2*a* and 2*b*, also already described, illustrate, respectively, two behaviour curves showing a particular design example of a mirror and an optical deflection element used in a basic hybrid headlight.
Figure 2B:
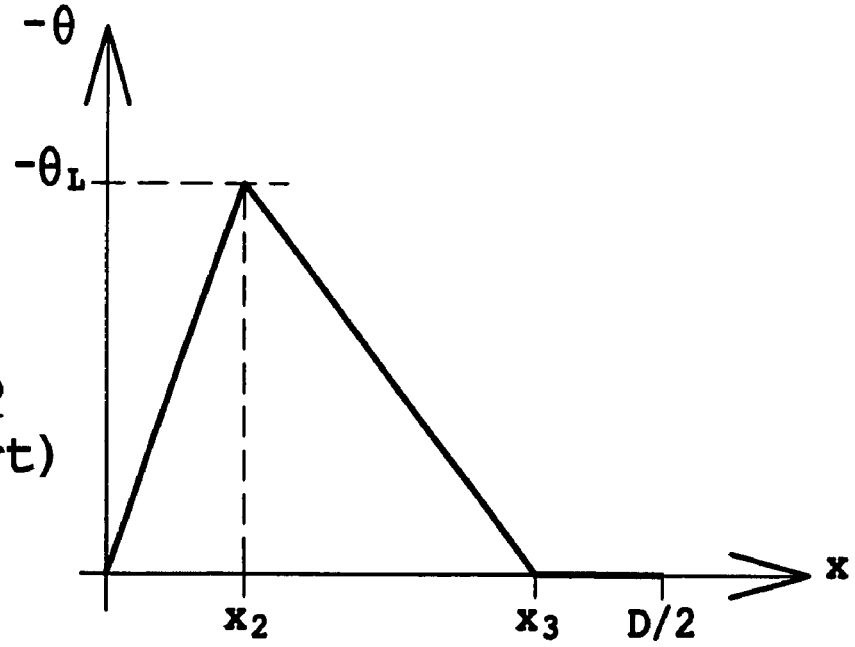
Fig. 2b (Prior Art)
Figure 3:
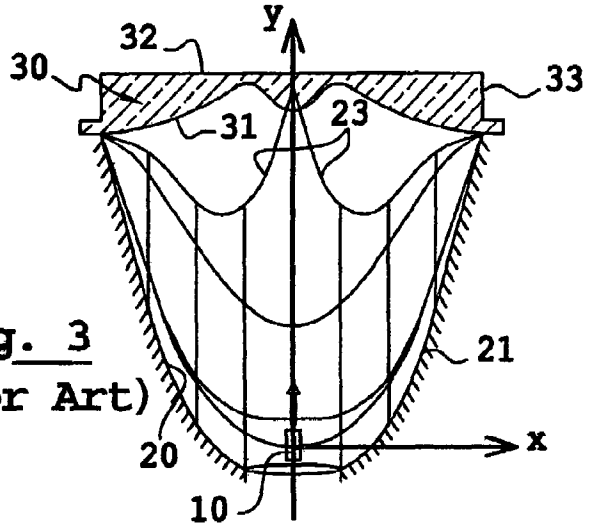
Fig. 3 (Prior Art)
FIG. 3, also already described, is a diagrammatic view, in an axial horizontal section, of an example of the basic hybrid headlight constructed according to this principle.
Figure 4:
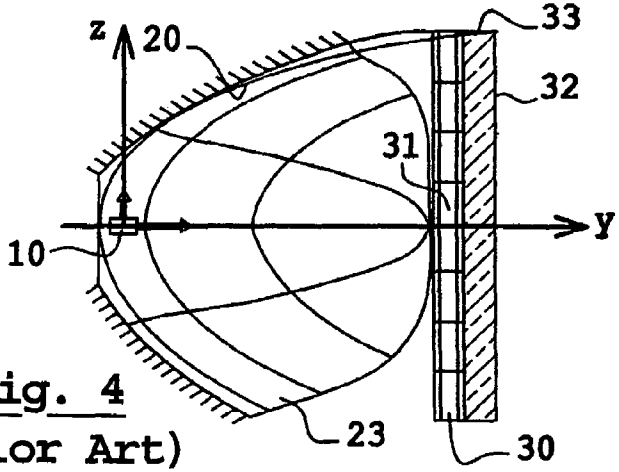
Fig. 4 (Prior Art)
FIG. 4, also already described, is a diagrammatic view, in an axial vertical section, of the headlight example shown in FIG. 3.
Figure 5:
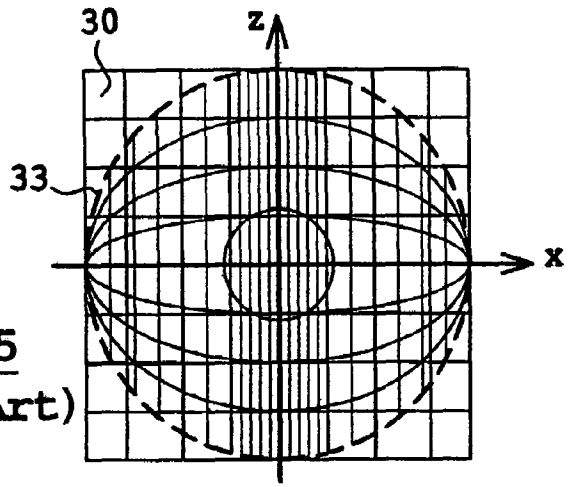
Fig. 5 (Prior Art)
FIG. 5, also already described, shows a front elevation of the optical element of the headlight example shown in FIGS. 3 and 4.
Figure 6:
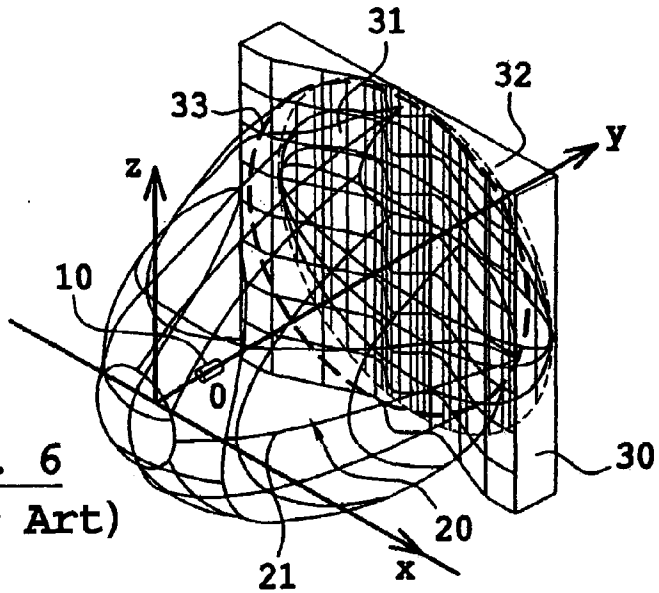
Fig. 6 (Prior Art)
FIG. 6, also already described, shows a perspective view, with trace lines, of the mirror and lens of the headlight shown in FIGS. 3 to 5.

The rotation of lateral strips 81 and 82 enables small images of the light source arranged inside the mirror to be raised in the beam of light produced by the headlight according to the invention, these images being of quite a high intensity. This results in a break 70 of the type shown in FIG. 7*a*. The rotation of central strip 83 enables larger images of the light source, but of a lower intensity, to be raised, thereby giving rise to a line of interruption of the type of line of interruption 71. The central lateral strip is located just to the left or right of central vertical axis 84, depending on the side on which line of interruption 71 is to be raised. In a particular embodiment of mirror 80, the inclination of lateral strips 81 and 82 is of the order of 3 degrees relative to the lateral strips adjacent to them, the inclination of central strip 83 being of the order of 1 degree relative to the strips adjacent to it. In this same example, whilst retaining the orthonormal reference in FIG. 1, the left-hand lateral strip is arranged between the −40 millimetre and −35 millimetre abscissae, the right-hand lateral strip is arranged between the 35 millimetre and 40 millimetre abscissae, and the central strip is arranged between the −10 millimetre and 0 millimetre abscissae.

The rotation of the strips is preferably achieved so that surfaces of connection between the rotated strips and their adjacent strips is exposed as little as possible to the light rays produced by the light source, in order not to introduce excessive interference in the light beam produced.

Also with a view to achieving a line of interruption of the type shown in FIG. 7*a*, it is proposed in the invention to arrange prisms on the admission face of the lens constituting the optical deflection element of the headlight instead of rotating strips of the mirror, or in addition to these rotations. These prisms, which constitute detachments on the admission face of the lens, are arranged on the vertical strips of the admission face of the lens opposing the vertical strips of the mirror, which are capable of being inclined according to the description just given. In practice the prisms are constructed in the same manner as the lens and constitute together with the latter a single piece. In order to detect on one side the line of interruption 71, their base is directed toward the top of the strips on which they are arranged. Their function is similar to that of the strips of the mirror, which are inclined: the prisms arranged on the extreme lateral strips of the exit face of the lens are intended to raise small intense images of the light source in order to create break 70, the prism arranged on a central strip being intended to extend this break by detecting larger, but less intense images of the light source.

Figure 7B:
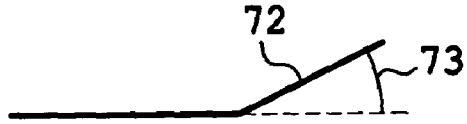

According to the invention, in order to achieve an interruption that is not flat, of the type shown in FIG. 7*b*, several additional possibilities are proposed: in all these examples the reflecting surface of mirror 20 of the basic hybrid headlights and/or admission face 31 of lens 30 of these same headlights has/have been modified.

Figure 9A:
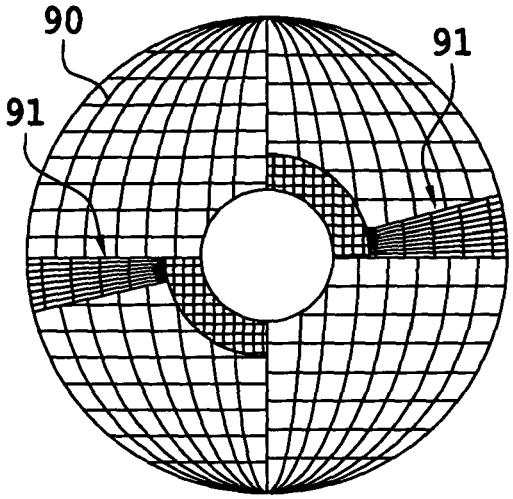
FIGS. 9*a* and 9*b* show different views of another embodiment of the surface of the mirror installed in the headlight device according to the invention.
Figure 9B:
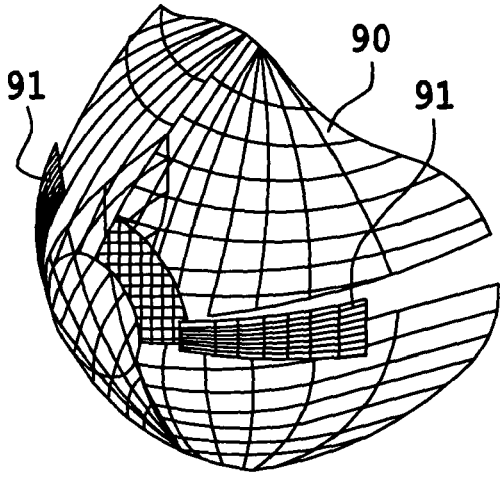
Figure 10A:
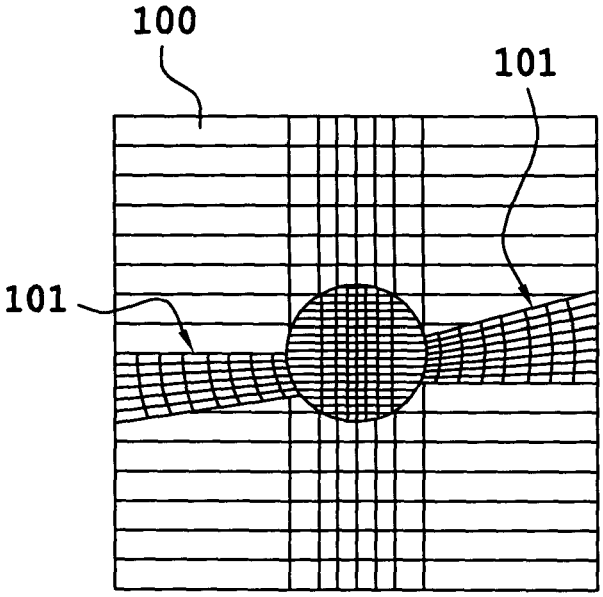
FIGS. 10*a* and 10*b* show different views of an embodiment of the surface of the lens installed in the headlight device according to the invention.
Figure 10B:
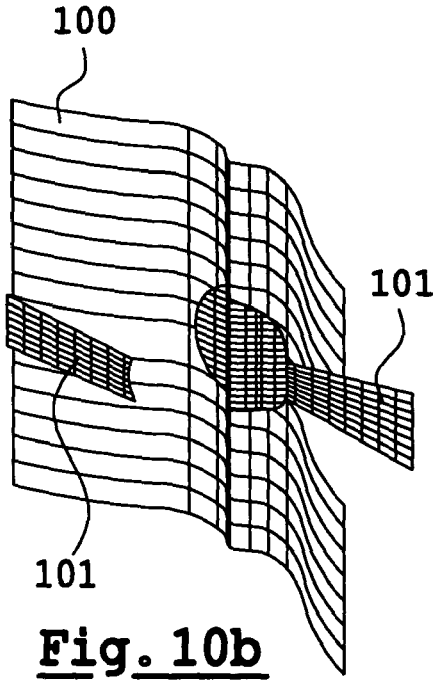

This gives rise, for example, to a new mirror 90, a possible embodiment of which is shown in FIG. 9*a* (front elevation of the mirror) and 9*b*, in different views. As part of such modifications of the reflecting surface of the mirror, detachments have been introduced on this surface. These detachments consist here of a replacement of a particular section 91 of the reflecting surface of mirror 90, the said particular section 91 corresponding to the lateral ends of a piece of the surface of the mirror resulting from the intersection of the reflecting surface of the mirror and the space defined, between a first central horizontal plane of the mirror and a second plane, inclined relative to the first plane, by a surface of the paraboloid type. By proceeding thus, and by selecting an angle of K degrees, 15 for example, between the two planes, an assembly of images of the light source is displaced, these images already being inclined 0 to K degrees in the particular section. This gives rise to a line of interruption of the type shown in FIG. 7*b*, with a rising angle of K degrees. Sections 101 may advantageously be sections of paraboloids (possibly different on the left and right) of foci located on the axis of the filament and inside the filament. The foci of the left-hand and right-hand sections are preferably combined at the centre or symmetrically offset. In all cases, observed in a rear view, the right-hand section has its focus in front of the centre of the filament (toward the lens), and the left-hand section has its focus behind the centre of the filament (toward the mirror).

In order also to obtain a line of interruption of the type shown in FIG. 7*b*, it is proposed in this invention, in addition to these modifications, to provide a new lens 100, slightly modified in relation to that used for the basic hybrid headlight devices. In the context of modifications of this kind to the inner, or admission face, of lens 100, detachments are introduced on that surface. Here too these detachments consist of a replacement of a particular section 101 of the inner face of lens 100, the said particular section 101 corresponding to the lateral ends of a piece of the inner face of the lens resulting from the intersection of this inner face and the space defined, between a first central horizontal plane of the lens and a second plane inclined in relation to the first plane, by a surface creating a neutral diopter, for example a flat surface element, or possibly an opening. By proceeding thus the images correctly inclined and positioned by zones 01 of the reflector are prevented from being displaced horizontally.

What is claimed is:

1. A headlight unit comprising light source, a mirror exhibiting a reflecting surface for reflecting light signals produced by the light source, and a transparent optical deflection element exhibiting an admission face for the reflected light signals and an exit face for the reflected light signals, the transparent optical deflection element being positioned in front of the mirror, the mirror being capable of interacting with the light source in order to generate a beam bounded by a cut-off line, and the optical deflection element being capable of providing a horizontal displacement of the light signals produced by the light source and reflected by the mirror, without modifying the vertical distribution of the light signals, and at least one detachment element arranged on at least the reflecting surface of the mirror or a surface of the optical deflection element reached by the light signals in order to obtain a cut- off line of the light beam that is not flat, wherein the at least one detachment element comprises at least one prism arranged on the transparent optical deflection element, and the transparent optical deflection element includes a surface with an admission face having arranged thereon vertical strips, the at least one prism being arranged on a vertical strip of the vertical strips and being part of the transparent optical deflection element.

2. A headlight unit according to claim 1, wherein among the prisms arranged on the optical deflection element, at least one prism is arranged on a lateral vertical strip of the optical deflection element.

3. A headlight unit according to claim 2, wherein each prism is arranged on the admission face of the reflected light signals of the optical deflection element.

4. A headlight unit according to claim 1, wherein among the prisms arranged on the optical deflection element a central prism is arranged on a central vertical strip, one of the edges of the central vertical strip being combined with a vertical central axis of the optical deflection element.

5. A headlight unit according to claim 4, wherein each prism is arranged on the admission face of the reflected light signals of the optical deflection element.

6. A headlight unit according to claim 1, wherein a base of each prism is arranged toward the top of each vertical strip on which a base of a prism is arranged, an apex of each prism being arranged toward the bottom of each vertical strip on which an apex of a prism is arranged.

7. A headlight unit according to claim 6, wherein each prism is arranged on the admission face of the reflected light signals of the optical deflection element.

8. A headlight unit according to claim 1, wherein each prism is arranged on the admission face of the reflected light signals of the optical deflection element.

9. A headlight unit according to claim 1, wherein at least one detachment element comprises the rotation of a vertical strip constituting the reflecting surface of the mirror in relation to an adjacent vertical strip of the mirror.

10. A headlight unit according to claim 9, wherein among rotations effected on the surface of the mirror there is at least one lateral rotation of a lateral vertical strip of the mirror.

11. A headlight unit according to claim 10, wherein each rotation of a vertical strip of the mirror is effected so that connecting surfaces appearing between the rotated vertical strips and the adjacent vertical strip are exposed to at least the light signals produced by the light source.

12. A headlight device according to claim 9, wherein for rotations effected on the surface of the mirror there is a central rotation device arranged on a central vertical strip of the mirror, one of the edges of this central vertical strip being combined with a vertical central axis of the mirror.

13. A headlight unit according to claim 12, wherein each rotation of a vertical strip of the mirror is effected so that connecting surfaces appearing between the rotated vertical strips and the adjacent vertical strip are exposed to at least the light signals produced by the light source.

14. A headlight unit according to claim 9, wherein each rotation of a vertical strip of the mirror is effected so that connecting surfaces appearing between the rotated vertical strips and the adjacent vertical strip are exposed to at least the light signals produced by the light source.

15. A headlight unit according to claim 1, wherein at least one detachment element comprises the replacement, by a surface of the paraboloid type, of a particular section of the reflecting surface of the mirror, the said particular section corresponding to the lateral ends of a piece of the surface of the mirror resulting from the intersection of the reflecting surface of the mirror and the space defined between a first central horizontal plane of the mirror and a second plane inclined relative to the first plane.

16. A headlight unit according to claim 15, wherein the inclination between the first plane and the second plane is of the order of 15 degrees.

17. A headlight unit according to claim 1, wherein at least one detachment element comprises the replacement by a flat surface, of a particular section of the admission face for the light signals of the transparent optical deflection, the particular section corresponding to the lateral ends of a piece of the surface of the admission face resulting from the intersection of the admission face and the space defined between a first central horizontal plane of the mirror and a second plane inclined in relation to the first plane.

18. A headlight unit according to claim 17, wherein the inclination between the first plane and the second plane is of the order of 15 degrees.

19. A headlight unit comprising light source, a mirror exhibiting a reflecting surface for reflecting light signals produced by the light source, and a transparent optical deflection element exhibiting an admission face for the reflected light signals and an exit face for the reflected light signals, the transparent optical deflection element being positioned in front of the mirror, the mirror being capable of interacting with the light source in order to generate a beam bounded by a cut-off line, and the optical deflection element being capable of providing a horizontal displacement of the light signals produced by the light source and reflected by the mirror, without modifying the vertical distribution of the light signals, and detachment elements arranged on the reflecting surface of the mirror and a surface of the optical deflection element reached by the light signals in order to obtain a cut-off line of the light beam that is not flat, wherein the detachment elements includes at least one detachment element comprising at least one prism arranged on the transparent optical element, and the transparent optical deflection element includes a surface with an admission face having arranged thereon vertical strips, the at least one prism being arranged on a vertical strip of the vertical strips and being part of the transparent optical deflection element, and wherein the detachment elements further includes at least one detachment element comprising the rotation of a vertical strip constituting the reflecting surface of the mirror in relation to an adjacent vertical strip of the mirror, the rotated vertical strip being one of a left-hand lateral vertical strip corresponding to a left end of the reflecting surface, a right-hand lateral vertical strip corresponding to a right end of the reflecting surface or a central vertical strip corresponding to a strip adjacent to a vertical central axis of the mirror.

* * * * *